US006598392B2

(12) United States Patent
Majeres

(10) Patent No.: US 6,598,392 B2
(45) Date of Patent: Jul. 29, 2003

(54) COMPRESSED GAS ENGINE WITH PISTONS AND CYLINDERS

(76) Inventor: William A. Majeres, 1506 S. Fairmount St., Sioux City, IA (US) 51106

( * ) Notice: Subject to any disclaimer, the term of this patent is extended or adjusted under 35 U.S.C. 154(b) by 3 days.

(21) Appl. No.: 09/997,606

(22) Filed: Dec. 3, 2001

(65) Prior Publication Data

US 2003/0101864 A1 Jun. 5, 2003

(51) Int. Cl.[7] ..... F01L 15/00

(52) U.S. Cl. ..... 60/370

(58) Field of Search ..... 91/354, 185, 188; 60/407, 409, 370; 251/251

(56) References Cited

U.S. PATENT DOCUMENTS

| | | | | | |
|---|---|---|---|---|---|
| 1,502,244 | A | * | 7/1924 | Gore | 91/188 |
| 3,980,152 | A | * | 9/1976 | Manor | 180/313 |
| 4,018,050 | A | * | 4/1977 | Murphy | 60/370 |
| 4,370,857 | A | * | 2/1983 | Miller | 91/188 |
| 4,651,525 | A | * | 3/1987 | Cestero | 60/407 |

* cited by examiner

*Primary Examiner*—Edward K. Look
*Assistant Examiner*—Igor Kershteyn

(57) ABSTRACT

A compressed gas engine includes a plurality of reciprocating pistons within cylinders, the pistons being driven by compressed gas from a source tank. Intake and exhaust valves selectively open to direct compressed gas to the piston to drive the piston, and to exhaust air, respectively. The valves are opened by a lift rod in engagement with cams on a crankshaft, and are closed by the compressed air.

4 Claims, 1 Drawing Sheet

COMPRESSED GAS ENGINE WITH PISTONS AND CYLINDERS

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to power plans for small vehicles, and more particularly to an improved vehicle which is powered by compressed gas rather than internal combustion.

(2) Background Information

Internal combustion engines have been operated on conventional liquid fuels such as gasoline or diesel fuel, for many years. However, such engines create pollution because of the combustion of these fuels.

While alternative fuels, such as natural gas, liquefied petroleum gas, and the like have been utilized as an alternative fuel source to reduce polluted content, the process of combustion of these fuels still results in exhaust gases containing pollutants and noxious fumes.

BRIEF SUMMARY OF THE INVENTION

It is therefore a general object of the present invention to provide an improved engine for small vehicles which will markedly advance the engine design of small cars, resulting in non-polluting emissions while allowing minimal breakdown of oil and parts over time.

Another object is to provide a compressed gas engine which operates on a totally renewal, inexpensive energy source.

Yet a further object of the present invention is to provide a compressed gas engine which is simple in design, inexpensive to manufacture, rugged in construction, easy to use, and efficient in operation.

These and other objects of the present invention will be apparent to those skilled in the art.

The compressed gas engine of the present invention includes a plurality of reciprocating pistons within cylinders, the pistons being driven by compressed gas from a source tank. Intake and exhaust valves selectively open to direct compressed gas to the piston to drive the piston, and to exhaust air, respectively. The valves are opened by a lift rod in engagement with cams on a crankshaft, and are closed by the compressed air.

BRIEF DESCRIPTION OF THE SEVERAL VIEWS OF THE DRAWING

The preferred embodiment of the invention is illustrated in the accompanying drawing, which is a diagrammatic view of the engine, showing two cylinders of the engine, with one cylinder in sectional view to show the interior components.

DETAILED DESCRIPTION OF THE INVENTION

Figure 1:
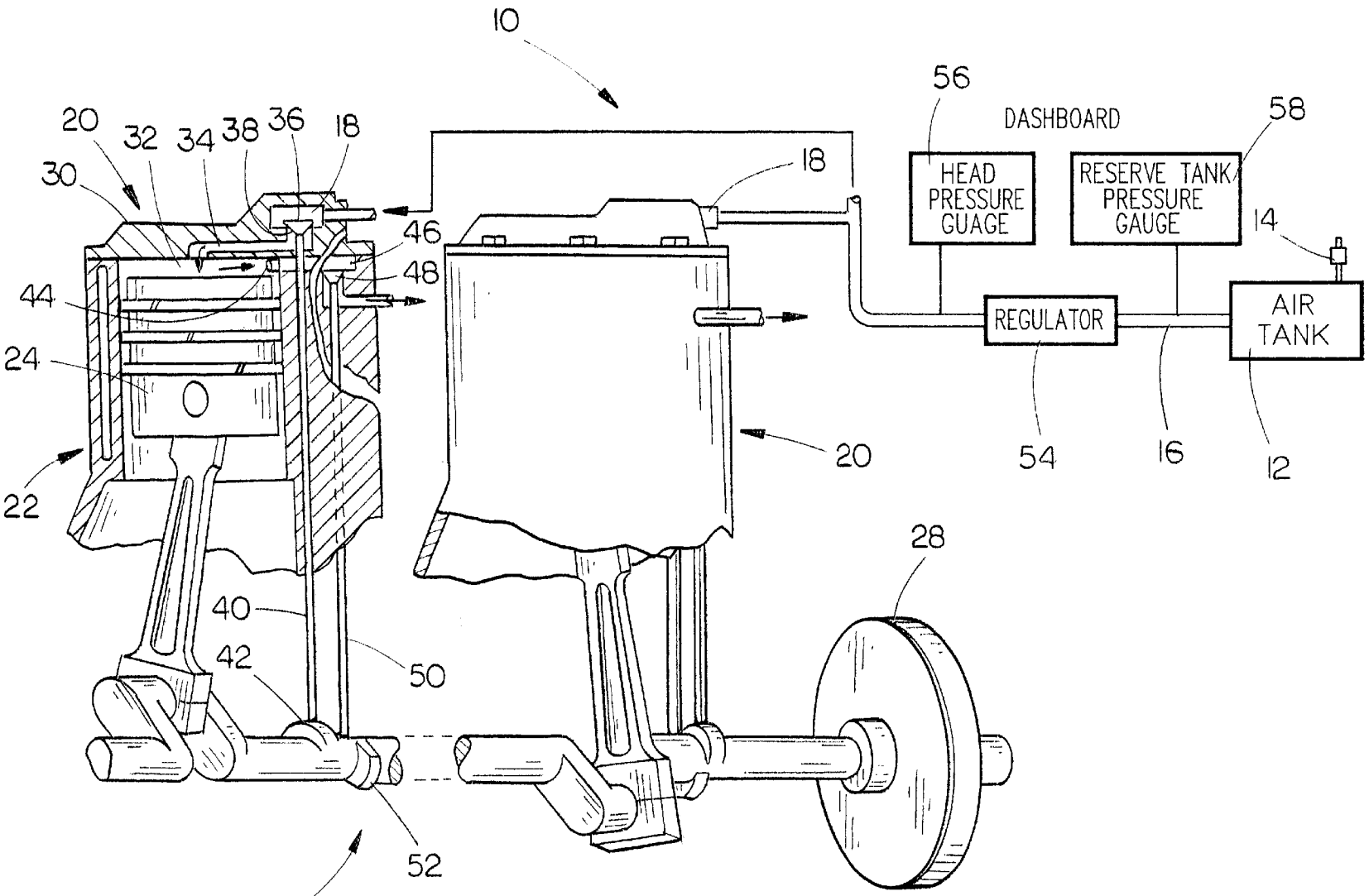

Referring now to the drawing, the compressed gas engine of the present invention is designated generally at 10 and is designed for use in providing power to a small vehicle or the like. Preferably, the compressed gas is air, or any other similar compressible, non-volatile gas.

A source of compressed gas is provided by air tank 12, which may be one or more individual tanks of compressed air. A valve 14 is provided on air tank 12 to permit the refilling of air tank 12 with compressed gas, as needed.

A pneumatic line 16 extends from air tank 12 to intake ports 18 on cylinders 20. Cylinders 20 are formed in an engine head 22, and house reciprocating pistons 24. Pistons 24 reciprocate to thereby cause the rotation of a crankshaft 26 in a conventional fashion. A flywheel 28 on the end of crankshaft 26 assists in maintaining the steady rotation of the crankshaft. Each cylinder 20 is enclosed at an upper end by a head plate 30 to form a compression chamber 32 between each piston 24 and head plate 30 within each cylinder 20. A passageway 34 communicates between compression chamber 32 and air intake port 18. Passageway 34 is selectively opened and closed by an operable valve 36 selectively journaled within a valve seat 38. Valve 36 is shifted to the open position by a lift rod 40 extending from valve 36 to a cam 42 on crankshaft 26. Thus, cam 42 will selectively raise lift rod 40 and move valve 36 out of contact with valve seat 38, to permit compressed from intake port 18 to pass through passageway 34 to compression chamber 32. The pressure of the compressed air within air intake port 18 will force valve 36 closed after cam 42 has rotated out of contact with lift rod 40.

A second passageway 44 extends from compression chamber 32 to an exhaust port 46. A second valve 48 is operable to open and close passageway 44 in exhaust port 46. Valve 48 is supported on a lift rod 50, in the same fashion as valve 36, for sequential operation by a cam 52 on crankshaft 26. Rotation of crankshaft 26 thereby, causes cam 52 to raise lift rod 50 and open valve 48 to permit the exhausting of gas from compression chamber 32. The force of the compressed gas within the compression chamber flowing through passageway 46 will cause valve 48 to close after cam 52 continues in its rotation on crankshaft 26.

In operation, rotation of crankshaft 26 will cause the sequential opening of valves 36 and 48 to selectively cause compressed gas to enter compression chamber 32 or the exhausted from compression chamber 32. This compressed air will force piston 24 downwardly, thereby rotating crankshaft 26 and powering the engine 10.

Because there is no combustion, engine 10 operates without exhausting any pollutants or dangerous fumes. Rather the source of power is compressed air; an inexpensive and renewable source of power.

Preferably, a high pressure high volume regulator 54 is interposed in pneumatic line 16 between air tank 12 and intake ports 18. Regulator 54 functions as a throttle to selectively release predetermined amounts of air/gas into the compression chambers of the cylinders of engine 10. Regulator 54 may be operated and controlled either mechanically or electronically, as desired.

Gauges 56 and 58 may be provided on a dashboard or other convenient location to provide a visual indicator of the pressure entering intake ports 18 as well as the pressure remaining in air tank 12, respectively.

Whereas the invention has been shown and described in connection with the preferred embodiment thereof, many modifications, substitutions and additions may be made which are within the intended broad scope of the appended claims.

I claim:

1. An engine driven by compressed gas, comprising:

an engine having a plurality of reciprocating pistons within cylinders, said pistons rotating a crankshaft;

each cylinder closed at an upper end by a head plate to form a compression chamber within each cylinder between each piston upper end and the head plate;

a plurality of intake passageways, each extending from one compression chamber through the head plate;

a plurality of intake valves, one in each intake passageway, each operable between open and closed positions to open and close each intake passageway;

a plurality of exhaust passageways, each extending from one compression chamber through the associated cylinder wall;

a plurality of exhaust valves, one in each exhaust passageway, each operable between open and closed positions to open and close each exhaust passageway;

a plurality of lift rods, each extending between one of said intake and exhaust valves and said crankshaft, for moving the valves to their open positions;

a plurality of cams on said crankshaft arranged to selectively open the intake and exhaust valves in a predetermined sequence;

a source of compressed gas connected via a pneumatic line to each of said intake passageways; and operable gas flow regulator interposed between the gas source and the intake passageways for selectively controlling the amount of gas provided to flow to the engine;

said valves arranged and shaped to be biased to a closed position by gas within the intake and exhaust passageways, respectively.

2. The engine of claim 1, wherein the compressed gas is air.

3. The engine of claim 1, further comprising a pressure gauge interposed between the source of compressed gas and the regulator.

4. The engine of claim 1, further comprising a pressure gauge interposed between the regulator and the intake passageways.

* * * * *